US005916040A

United States Patent [19]

Umazume

[11] Patent Number: 5,916,040

[45] Date of Patent: Jun. 29, 1999

[54] GOLF CLUB

[75] Inventor: Kosuke Umazume, Mitaka, Japan

[73] Assignee: Kabushiki Kaisha Senkeikagakukenkyujyo, Japan

[21] Appl. No.: 09/001,641

[22] Filed: Dec. 31, 1997

[30] Foreign Application Priority Data

Oct. 23, 1997 [JP] Japan ..... 9-290990
Nov. 14, 1997 [JP] Japan ..... 9-313460

[51] Int. Cl.[6] ..... A63B 53/10

[52] U.S. Cl. ..... 473/317

[58] Field of Search ..... 473/316, 317, 473/282, 228; D21/757

[56] References Cited

U.S. PATENT DOCUMENTS

| | | | |
|---|---|---|---|
| 1,171,806 | 2/1916 | Scott . | |
| 1,396,470 | 11/1921 | Taylor | 473/317 |
| 2,018,723 | 10/1935 | Hutchison | 473/317 |
| 2,027,635 | 1/1936 | Cunningham | 473/317 |
| 2,088,095 | 7/1937 | Sargent | 473/327 |
| 5,545,094 | 8/1996 | Hsu | 473/317 |

FOREIGN PATENT DOCUMENTS

| | | |
|---|---|---|
| 5192424 | 8/1993 | Japan . |
| 7108073 | 4/1995 | Japan . |
| 8131588 | 5/1996 | Japan . |
| 9668 | 1/1997 | Japan . |
| 956895 | 3/1997 | Japan . |
| 999122 | 4/1997 | Japan . |
| 9140839 | 6/1997 | Japan . |
| 9140840 | 6/1997 | Japan . |
| 9206413 | 8/1997 | Japan . |
| 9327873 | 12/1997 | Japan . |

*Primary Examiner*—Sebastiano Passaniti
*Attorney, Agent, or Firm*—Gifford, Krass, Groh, Sprinkle, Anderson & Citkowski, P.C.

[57] ABSTRACT

A golf club capable of being swung faster than a conventional golf club having a club shaft, of which cross-section is circular, is newly invented. The golf club according to the invention has a club shaft, at least a part of which has an arcuate cross-section such as a semicircle on a face side of a club head and has a square cross-section such as a dovetail groove-shape on a back side of the head.

9 Claims, 4 Drawing Sheets

GOLF CLUB

BACKGROUND OF THE INVENTION

1. Field of the Invention

The present invention relates mainly to a golf club and, more particularly, to those with shafts that have a specified cross-sectional shape.

2. Brief Description of the Prior Art.

So far golf clubs such as wood clubs have been accelerated in unweighting and in elongation in response to an enlargement in size of club heads. Recently, lightweight wood clubs with total weights between 290 and 300 grams have increased in number and ultra-lightweight clubs with total weights below 290 grams have appeared on the market.

If a golf club is lighter, one can swing the club faster to raise its head speed, assuming the length of the club is the same. Accordingly, the lightening and elongation of clubs have an advantage on the flying distance of a golf ball.

The aforementioned unweighting and elongation of the golf clubs are attained mainly by a progress in lightening the shafts and grips of the golf clubs.

However, as to the club shaft, its weight reduction has been realized by replacement of its constituting material with a lighter weight substance such as carbon fiber, while assuming the that cross-sectional shape of the shaft is a circle. So far, a substance lighter than carbon fiber has not appeared on the market. Consequently, weight reduction of the club based on changes in shaft material has a certain limitation.

SUMMARY OF THE INVENTION

The present invention is carried out to solve the problems mentioned above. An object of the present invention is to provide a golf club capable of being swung faster, which is attainable not by the lightening of the shaft material but attainable by deforming the cross-sectional shape of the club shaft.

To satisfy the aforementioned purposes, the present invention provides a golf club having the following constitutions:

(1) A golf club, wherein:
a cross-sectional shape of at least a part of a golf shaft is deformed to be an uncircular shape which can reduce an air resistance from a face side toward a tail side of a club head, thereby to increase a head speed of the club.

(2) The golf club according to (1), wherein:
the uncircularly shaped cross-section of the golf shaft is symmetrical with respect to a plane, which includes a center axis of the shaft and is approximately parallel to a target direction of a golf ball to be hit by the club.

(3) The golf club according to (1), wherein:
the uncircularly shaped cross-section of the golf shaft is a symmetrical with respect to the plane, which includes the center axis of the shaft and is approximately parallel to the target direction of the golf ball to be hit by the club.

(4) The golf club according to (1), (2) and (3) wherein:
the uncircularly shaped cross-section of the golf shaft has an arcuated shape on the face side of the club head and a square shape on the back side of the club head.

(5) The golf club according to (4), wherein:
two opposite sides of the square shape of the uncircularly shaped cross-section intersect respectively a third side located inbetween so as to make respective interior angles smaller than 90° to form a dovetail groove-shaped cross-section.

Because a shaft of a golf club according to the present invention has an uncircular cross-sectional shape such as an arcuate shape on a face side of a club head and a square shape on a back side of the club head, the air resistance of the club shaft is reduced during a forward swing of the club. These reduction are clarified from investigation results shown in FIG. 1, which indicate the cross-sectional shape dependence of rotational torque measured about the club shafts.

The air resistance can be defined as a difference in rotational torque between a value measured in an open air and another value measured in vacuo. The value of the rotational torque measured in vacuo is constant so long as its moment of inertia is constant because the value measured in vacuo does not depend a priori on a cross-sectional shape of the shaft. Accordingly, it is easily acceptable here that the air resistance is linearly dependent on the rotational torque measured in the open air.

In FIG. 1, various sorts of the cross-sectional shapes are compared concerning the air resistance (namely, the rotational torque) of the club shafts. They are a conventional shaft $S_1$, of which cross-sectional shape is circular, another shaft $S_2$, of which cross-sectional shape is semicircular, still another shafts $S_3$ and $S_4$, of which cross-sections are square and further still another shaft $S_5$, of which cross-section is arcuate on the face side and square on the back side of the head. The tube thickness of the shafts from $S_1$ to $S_5$ is 2.2 millimeters (referred to as mm hereinafter) thick at the tip while is 1.4 mm thick at the grip side (namely, on a rotation axis 2 side shown in FIGS. 2A and 2B). A material used for all of the shafts is a carbon fiber.

The air resistances (the rotational torques) of the respective shafts $S_1$ to $S_5$ are measured by a use of the rotational torque testing machine shown in FIGS. 2A and 2B. Namely, the respective shafts are loaded individually on a rotational arm 3, which is installed perpendicularly to the rotation axis 2 driven by a driving motor 1 as shown in the figure. In FIG. 1, an abscissa indicates the rotational torque of the shaft measured by use of a torque meter 4 in kg*m while an ordinate indicates a rotational speed in rps (rotation numbers per second) and a linear velocity of the shaft on the tip, respectively. Each rotational torque indicated on the abscissa of FIG. 1 is an intrinsic torque induced only by the shaft because a value obtained by measuring during loading a gripping area of the shaft, which is 700 mm-distant from the tip of the shaft, on a top of the 850 mm-long rotational arm 3 as can be seen from FIGS. 2A and 2B is subtracted with another background value obtained by measuring during unloading the shaft from the arm 3.

Incidentally, Reynold's numbers during measurement here stay within an order of four to the ten (referred to as $\mathbf{10}^4$ hereinafter) compared with an order of $10^5$, which encounters with a golf ball hit by the club shaft during flying.

At the rotational speed of 5 rps, it is clarified from FIG. 1 that the shaft $S_2$ having the semicircular cross-section, of which rotational speed dependence of the rotational torque is represented by a curve (2), exhibits approximately a 16%-less air resistance with respect to that of the shaft $S_1$ having the circular cross-section, of which rotational speed dependence of the rotational torque is represented by another curve (1). At the rotational speed of 5 rps, it is further clarified from FIG. 1 that the shaft $S_5$ having the semicircular cross-section, of which rotational speed dependence of the rotational torque is represented by still another curve (5), similarly exhibits approximately even a 25%-less air resistance with respect to that of the shaft $S_1$ having the conventional cross-section.

Because the golf shafts according to the present invention have less air resistance than conventional golf shafts, as mentioned above, swing speeds of the golf clubs according to the present invention increase compared with those of the conventional golf clubs if the other conditions except for the cross-sectional shape of the golf shaft are unified between them. The higher swing speed raises the head speed of the golf club in a tangential direction during swinging, which increases the flying distance of a golf ball.

In other words, an extent of the increase in swing speed of the golf club according to the present invention depends on an extent of the decrease in air resistance with respect to the conventional golf club so long as an torque applied to a grip during swinging the golf club and the other conditions except for the cross-sectional shape are the same. On the contrary, an elongation of the club shaft is attainable dependently upon an amount that the air resistance is reduced. The elongation of the club shaft further increases the head speed, resulting in further increasing the flying distance of the golf ball.

DETAILED DESCRIPTION OF THE PREFERRED EMBODIMENTS

Hereinafter detailed are the modes carrying out the present invention into practice with reference to the preferred embodiments. The best mode will be also described corresponding to the embodiments.

Figure 4:
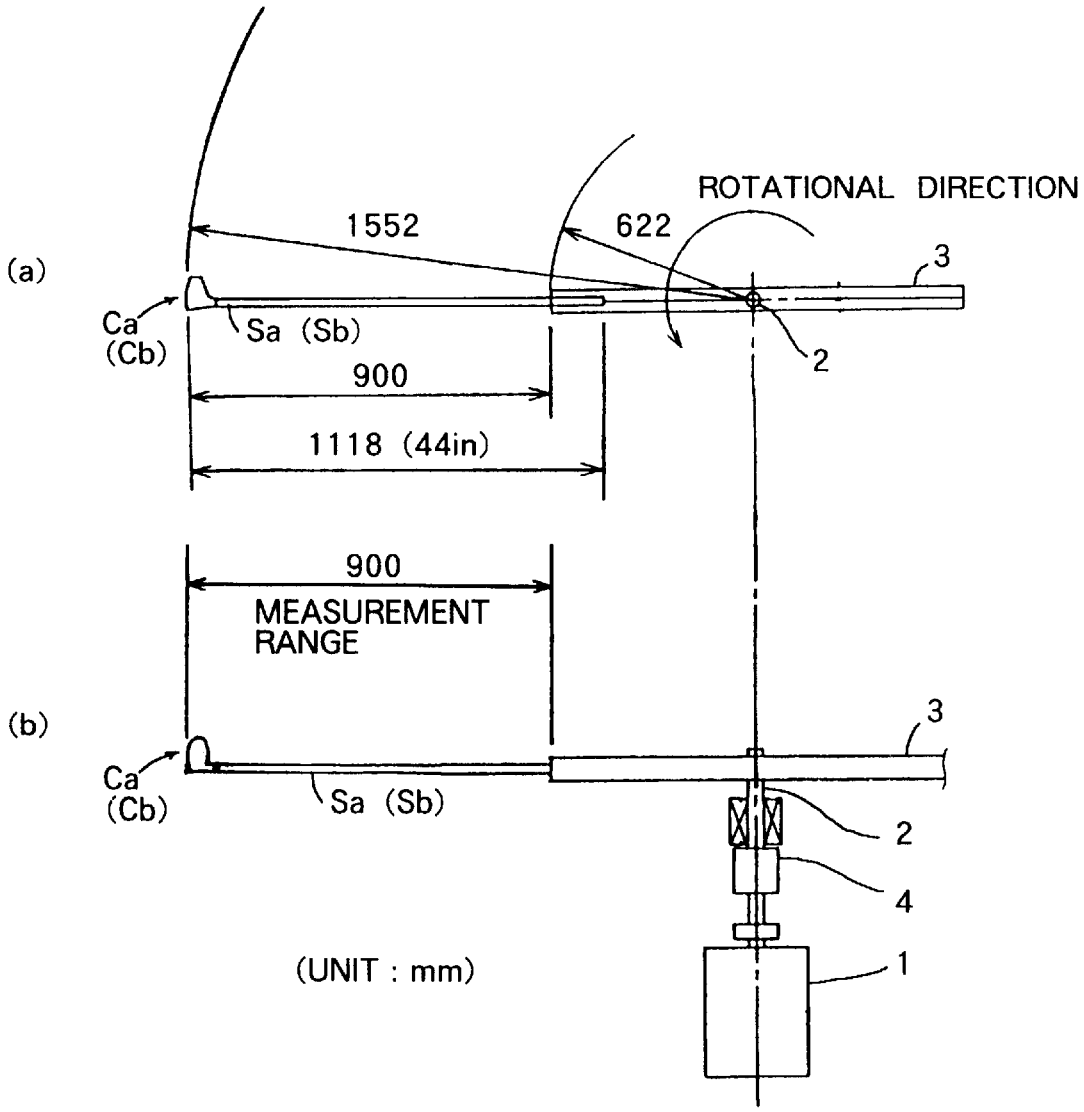
FIG. 4A is a plan view showing another rotational torque testing equipment for measuring the rotational torques of the golf clubs compared in FIG. 3.
FIG. 4B is a longitudinal section view of FIG. 4A.

In FIGS. 4A and 4B, a golf club Cb according to the present embodiment is illustrated. The golf club Cb is a sort of No. 1 wood club (so called "driver") having a length of 44 inches (1,118 mm). A shaft Sb of the driver is a so called "carbon shaft" formed by baking a molded compact out of carbon fibers and epoxy plastic resins. A total weight of the club Cb is 340 gram while a head volume of the club Cb is 190 $cm^3$.

Figure 3:
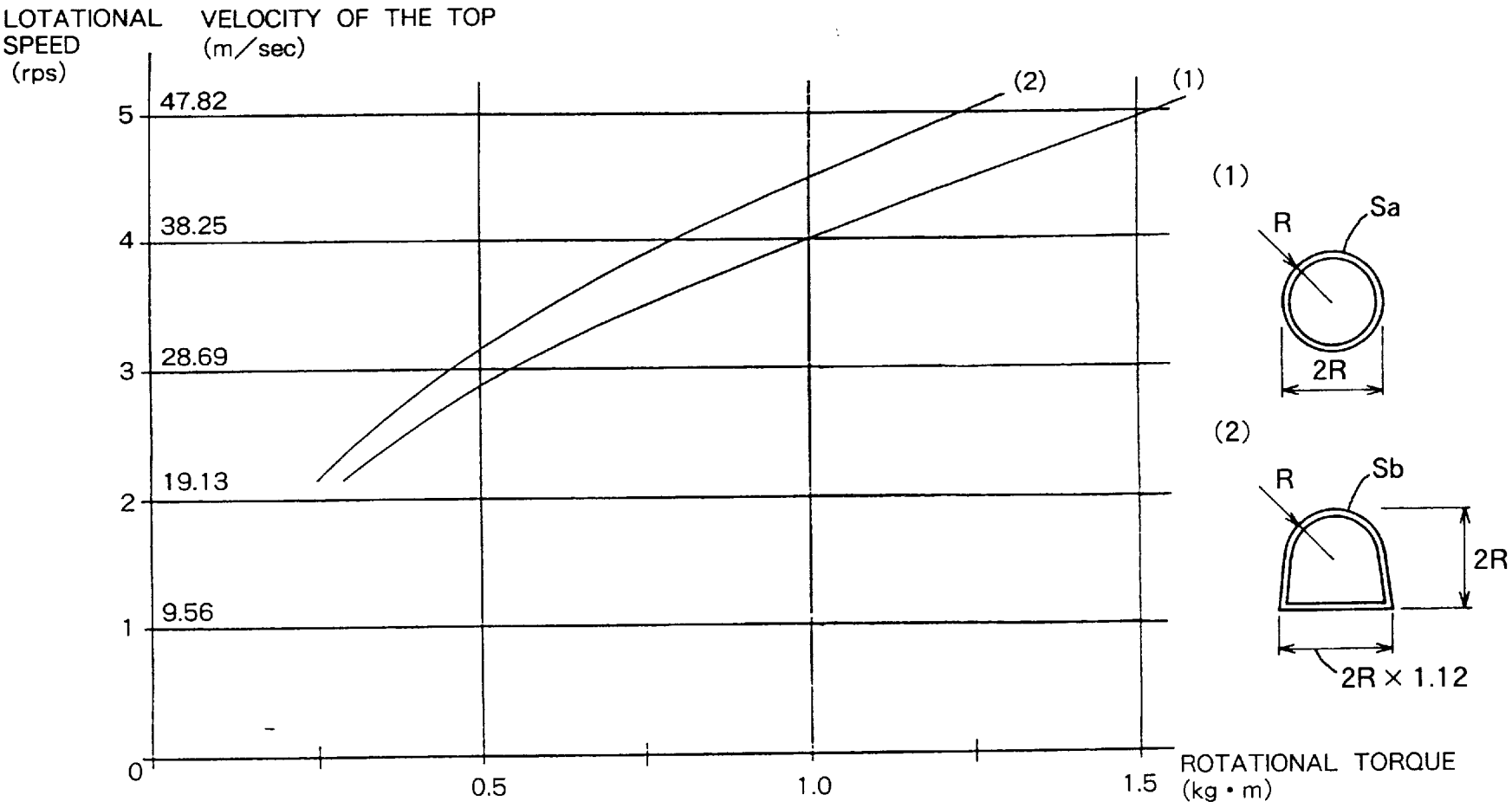
FIG. 3 is a graph illustrating a cross-sectional shape dependence of rotational torques measured about golf clubs.

In FIG. 3, the cross-sectional shape of the club shaft Sb according to the present invention is illustrated. Herein the cross-section of the shaft Sb has a semicircular shape on a fore side of the head while it has substantially a dovetail groove-shaped cross-section on a rear side of the head wherein an approximately square-shaped cross-section is enlarging toward a rear end. A radius of curvature of the cross-section on the fore side of the shaft Sb is actually R while a base length of a trapezoid of the shaft Sb on the rear side of the head is 2R multiplied by 1.12.

In the present embodiment, diameters (2R) of the club shaft Sb are 15.0 mm-PHI on a grip end and 8.5 mm-PHI on a tip end of the shaft. The shaft has a 2.2 mm in tube thickness on the tip end while has a 1.4 mm on the grip end.

In a graph shown in FIG. 3, rotation speed dependences of the air resistance (the rotational torque) are shown. Here the dependence curve (2) measured about the wood club Cb according to the present embodiment is compared with that (1) measured about the conventional wood club Ca. The conventional wood club Ca is provided with a club shaft Sa shown in FIG. 4 instead of the club shaft Sb equipped to the golf club Cb according to the present embodiment. The constitution of the conventional golf club Ca is quite similar to the golf club Cb according to the present embodiment except for its shaft Sa.

The cross-sectional shape of aforesaid shaft Sa has a circular form and a diameter of 2R. The diameters 2R of the club shaft Sa are similarly 15 mm-PHI on the grip end while 8.5 mm-PHI on the tip end. The wall thicknesses of the club shaft Sa are also 2.2 mm on the smaller diameter end while 1.4 mm on the larger diameter end.

Figure 1:
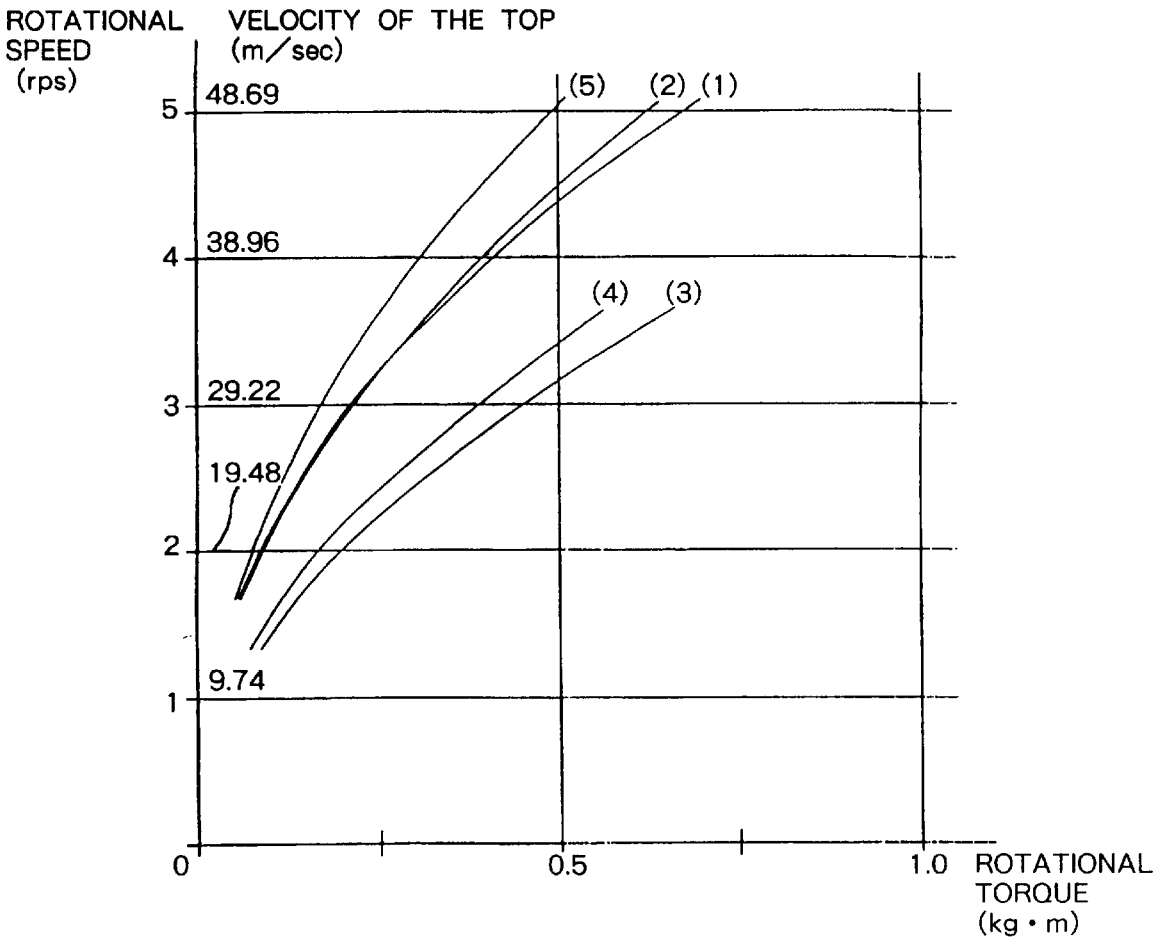
FIG. 1 is a graph illustrating a cross-sectional shape dependence of rotational torques measured about golf shafts.
Figure 1:
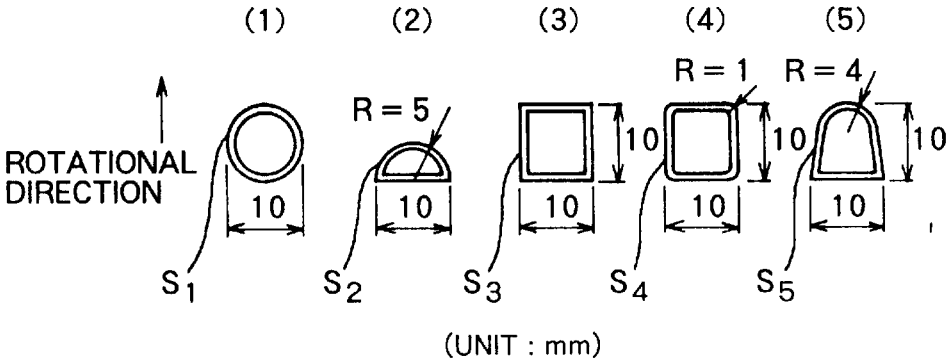
Figure 2:
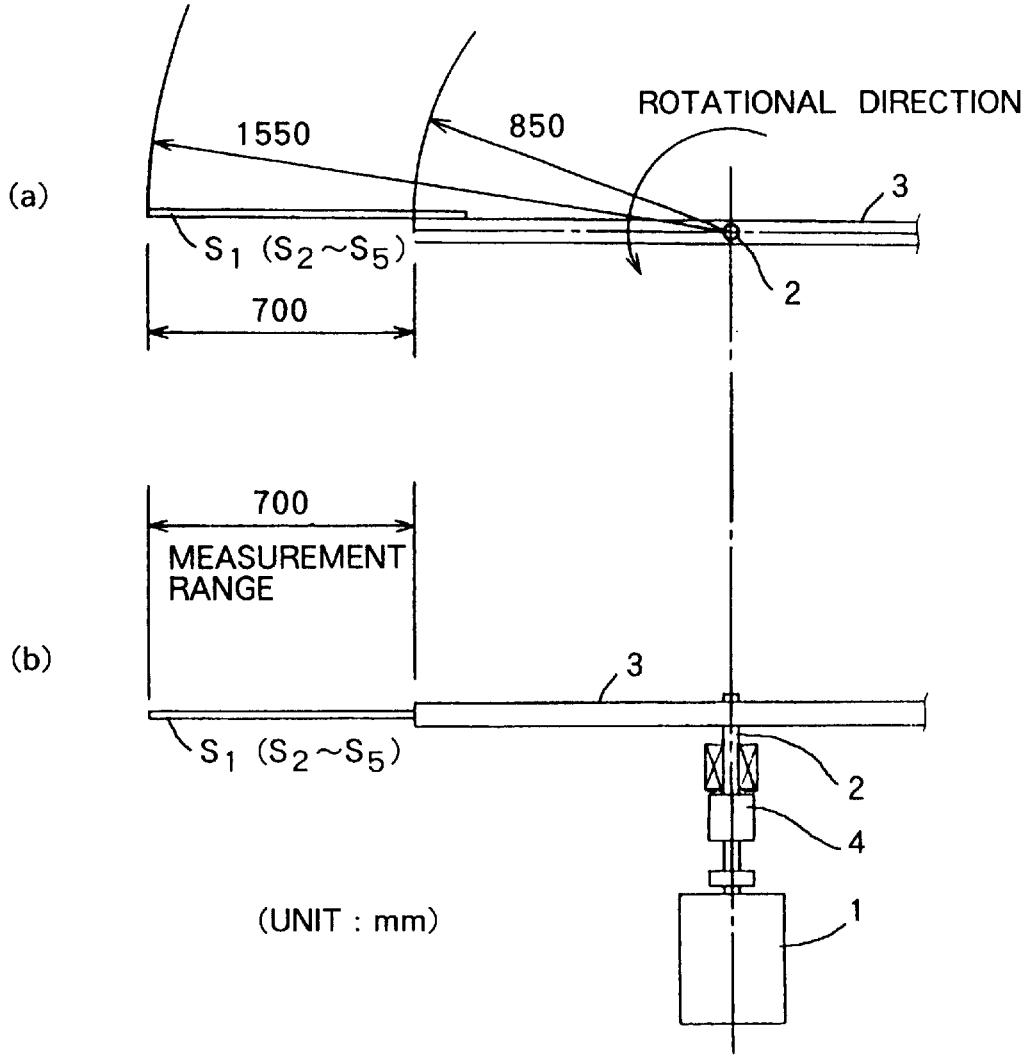
FIG. 2A is a plan view showing a rotational torque testing equipment for measuring the rotational torques of the golf shafts compared in FIG. 1.
FIG. 2B is a longitudinal section view of FIG. 2A.

Both air resistances (rotational torques) of the club shafts Ca and Cb are measured by a use of a rotational torque measuring machine shown in FIGS. 4A and 4B. A constitution of the machine mentioned above is essentially the same as that shown in FIGS. 2A and 2B. On the contrary, the length of the arm 3 is shortened to 622 mm to fit an actual radius in swing ark of 1552 mm. The swing ark of 1552 mm is empirically decided here for a golfer having an average height of 170 cm to obtain an average head speed of 40 m/sec. The measurement of the rotational torques of the golf clubs Ca and Cb covers a 900 mm length from a sole of the club head toward the grip of the shafts Sa and Sb.

At the rotational speed of 5 rps, it is clarified from FIG. 3 that the air resistance (2) of the wood club Cb, of which cross-section is arcuate-shaped on the face side of the head and square-shaped on the back side of the head as shown in the golf shaft Sb, has about a 20% less value than the air resistance (1) of the conventional wood club Ca, of which cross-section is circular-shaped as shown in the club shaft Sa. The golf club Cb according to the present embodiment has the less air resistance mentioned above, the swing speed of the club can be faster compared with that of the conventional club Ca. Consequently, the tangential velocity of the club head during swinging is raised faster to elongate the flying distance of the golf ball than that of the up-to-now.

Incidentally, aforesaid embodiment is described as to the shaft, of which cross-section has the arcuate shape on the face side and the square shape on the back side of the head from end to end throughout the shaft. However, the similar effect is obtainable, larger or smaller, to the shaft, which has the arcuate-shaped cross-section on the face side and the square-shaped cross-section on the back side only partly along the shaft. On the other hand, the material of the club shaft is not restricted to the carbon fiber. Metallic substances may be available to the shaft. The material of the club head is not limited to the wood, either. Metallic substances also may be available to the club head.

Furthermore, the characteristic property of the golf club according to the present invention is that the club shaft has the uncircular cross-section compared with the circular cross-section of the conventional golf club. Moreover, the any uncircular cross-sections can be carried out into practice whether the shape of the cross-section may be symmetric or asymmetric with respect to the plane intersecting the central axis of the shaft and being parallel to the target direction of the golf ball. Aforesaid plane may be approximately identical, for instance, to a swing plane that Mr. William Benjamin Hogan defined in his literary works.

Particularly, the asymmetric shape with respect to aforesaid plane has an advantage that the club can adjust a twisting direction of the shaft during swinging the club toward a desired direction. Accordingly, players turn capable of hitting either a hock ball or a slice ball intentionally. Further, all of the uncircular cross-sections such as an ellipse or an egg-shape, which can reduce the air resistance anyhow, are available to the fore side of the shaft.

Furthermore, excess concavities and convexities can be attached in the desired positions located adjacently to the asymmetric cross-sectional shape depending on necessities to reduce the air resistance further as well as to strengthen the club shaft, resulting in a further increase in head speed of the club during swinging. Herein the cross-sectional shape of the circular form on the fore side and the square form on the back side is applicable not only to the golf shaft but also to other usages.

As mentioned above, the golf shaft according to the present invention is constituted so as to be capable of having a reduced air resistance. Accordingly, one can swing the golf club according to the present invention faster than the conventional golf club so that one can elongate the flying distance of the hit golf ball.

What is claimed is:

1. A golf club wherein:

a cross-sectional shape of at least a portion of a golf shaft is deformed to be an uncircular shape which can reduce an air resistance from a face side toward a tail side of a club head, thereby to increase a head speed of said club, said uncirculary shaped cross-section having an arcuate shape toward said face side of said club bead and a square shape toward said tail side of said club head, two opposite sides of said square shape intersecting respectively a third side so as to make respective interior angles smaller than 90° to form substantially a dove tail groove-shaped cross-section.

2. The golf club according to claim 1, wherein:

said uncircularly shaped cross-section of said golf shaft is symmetrical with respect to a plane, which includes a center axis of said shaft and is proximately parallel to a target direction of a golf ball to be hit by said club.

3. The golf club according to claim 1, wherein:

said uncircularly shaped cross-section of said golf shaft is symmetrical with respect to said plane, which includes said center axis of said shaft and is approximately parallel to said target direction of said golf ball to be hit by said club.

4. The golf club according to claim 1, wherein said arcuate shape toward said face side of said club head has a radius R and said golf shaft has a face side to tail side length 2R.

5. The golf club according to claim 1, wherein said arcuate shape toward said face side of said club head has a radius R and said third side of said square shape has a length 1.12×2R.

6. The golf club according to claim 1, wherein said arcuate shape toward said face side of said club head has a radius R, said golf shaft has a face side to tail side length 2R, and said third side of said square shape has a length 1.12×2R.

7. The golf club according to claim 1, wherein only a portion of said golf shaft is deformed to be an uncircular shape.

8. The golf club according to claim 1, wherein substantially all of said golf shaft below a grip area is deformed to be an uncircular shape.

9. A golf club shaft comprising:

at least a portion of the golf club shaft having an uncircular cross-sectional shape with an arcuate portion toward a first face and a square portion toward a second face, said square portion comprising two opposite sides intersecting a third side so as to form two angles smaller than 90° to form substantially a dovetail groove-shaped cross-section.

* * * * *

UNITED STATES PATENT AND TRADEMARK OFFICE

CERTIFICATE OF CORRECTION

PATENT NO. : 5,916,040

DATED : June 29, 1999

INVENTOR(S) : Kosuke Umazume

It is certified that error appears in the above-identified patent and that said Letters Patent is hereby corrected as shown below:

Column 1, line 11 - Replace "unweighting" with --lighting--.
Column 1, line 20 - Replace "unweighting" with --lightening--.
Column 1, line 47 - Delete "an".
Column 1, line 48 - Delete "a" (second occurrence).
Column 1, line 58 - Replace "symmetrical" with --assymetrical--.
Column 2, line 44 - Replace "an" with --the--.
Column 2, line 45 - Replace "an" with --the--.
Column 2, line 47 - Replace "on" with --at--.
Column 2, line 52 - Delete "a".
Column 2, line 53 - Replace "with " with --from--.
Column 2, line 57 - Replace "four to the ten" with --ten to the fourth".
Column 2, line 58 - Replace "encounters" with --correspondes to--.
Column 2, line 63 - Delete "a".
Column 3, line 4 - Delete "a".
Column 3, line 19 - Delete "an".
Column 3, line 22 - Delete "an".
Column 4, line 28 - Replace "ark" with --arc-- (both occurrences).
Column 4, line 41 - Replace "The" with --Since the-- (first occurrence).
Column 4, line 42 - Replace "less" with --lower--.
Column 4, line 45 - Replace "raised faster" with --increased--.
Column 4, line 46 - Replace "than" with --compared with--.
Column 4, line 46 - Replace "of" with --resulting from--.
Column 4, line 46 - Replace "up-to-now" with --conventional club--.
Column 4, line 63 - Delete "the" (second occurrence).
Column 5, line 7 - Replace "turn" with --become--.
Column 5, line 8 - Replace "hock" with --hook--.
Column 5, line 23 - Replace "the" with --a--.

UNITED STATES PATENT AND TRADEMARK OFFICE

CERTIFICATE OF CORRECTION

PATENT NO. : 5,916,040

DATED : June 29, 1999

INVENTOR(S) : Kosuke Umazume

It is certified that error appears in the above-identified patent and that said Letters Patent is hereby corrected as shown below:

Column 5, line 24 - Replace "the" with –a–.
Column 5, line 34 - Replace "bead" with –head–.
Column 6, line 8 - Replace "symmetrical" with –assymetrical–.
Column 6, line 8 - Replace "said" with –a–.
Column 6, line 9 - Replace "said" with –a–.
Column 6, line 10 - Replace "said" with –a–.

Signed and Sealed this

Twenty-sixth Day of December, 2000

*Attest:*

Q. TODD DICKINSON

*Attesting Officer*

*Director of Patents and Trademarks*